US006001177A

United States Patent [19]

Gendreau et al.

[11] Patent Number: 6,001,177

[45] Date of Patent: Dec. 14, 1999

[54] GOLF BALL PAINT DELIVERY SYSTEM

[75] Inventors: Richard K. Gendreau, Springfield; Frank S. Carey, Longmeadow, both of Mass.

[73] Assignee: Spalding Sports Worldwide, Inc., Chicopee, Mass.

[21] Appl. No.: 08/876,064

[22] Filed: Jun. 13, 1997

[51] Int. Cl.[6] ..... B05B 7/00

[52] U.S. Cl. ..... 118/300; 239/422; 239/428

[58] Field of Search ..... 239/422, 428, 239/410, DIG. 14; 118/315, 313, 300; 427/421, 425

[56] References Cited

U.S. PATENT DOCUMENTS 2,724,615 11/1955 Ariotti ..... 239/428

3,598,322 8/1971 Rupert et al. ..... 239/410

*Primary Examiner*—Laura Edwards

[57] ABSTRACT

A spray gun for coating golf balls having an axial bore formed therein. The bore has a first end connected to an air compressor for receiving a flow of air therefrom and a second open end defining a nozzle. Each spray gun further includes a first paint input channel for receiving a first fluid. The first paint input channel has an outlet in communication with the axial bore for injecting the first fluid into the flow of air. Each spray gun also has a second paint input channel for receiving a second fluid, wherein the second paint input channel has an outlet in communication with the axial bore for injecting the second fluid into the flow of air. The outlet of the second paint input channel is offset from the outlet of the first paint input channel.

1 Claim, 3 Drawing Sheets

FIG 4
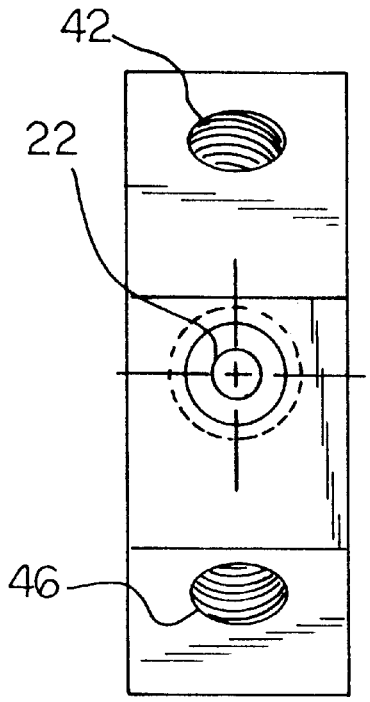
FIG 5
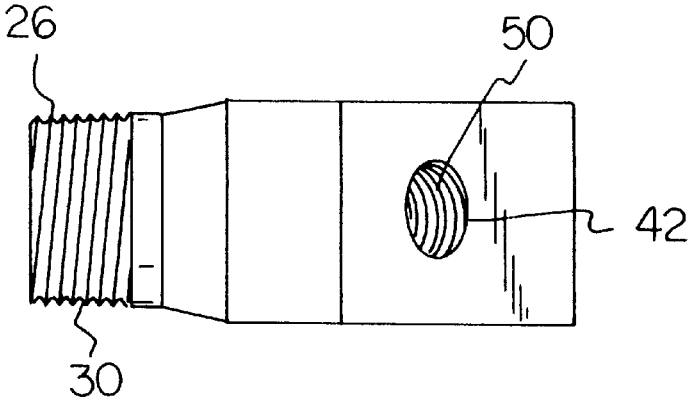
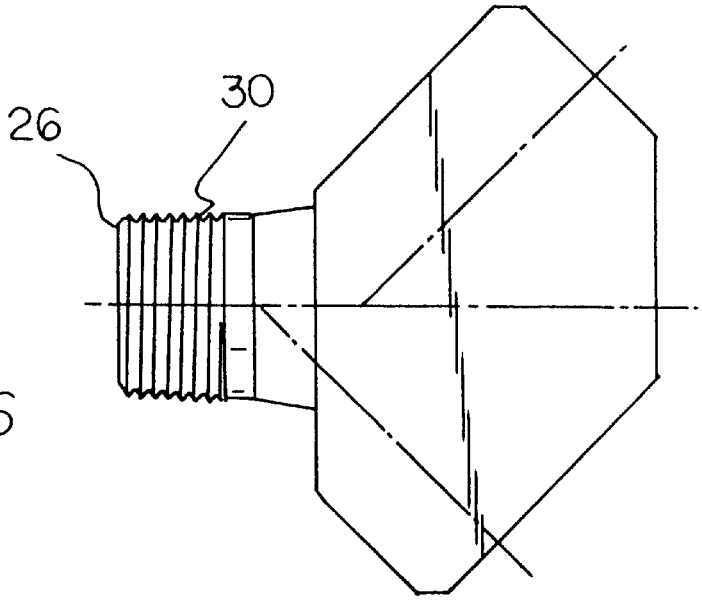
FIG 6

GOLF BALL PAINT DELIVERY SYSTEM

BACKGROUND OF THE INVENTION

1. Field of the Invention

The present invention relates to a golf ball paint delivery system and more particularly pertains to mixing paint adjacent to a nozzle of a spray gun from which the paint is delivered.

2. Description of the Prior Art

The use of paint delivery systems is known in the prior art. More specifically, paint delivery systems heretofore devised and utilized for the purpose of coating golf balls are known to consist basically of familiar, expected and obvious structural configurations, notwithstanding the myriad of designs encompassed by the crowded prior art which have been developed for the fulfillment of countless objectives and requirements.

In this respect, the golf ball paint delivery system according to the present invention substantially departs from the conventional concepts and designs of the prior art, and in so doing provides an apparatus primarily developed for the purpose of mixing paint adjacent to a nozzle of a spray gun from which the paint is delivered.

Therefore, it can be appreciated that there exists a continuing need for a new and improved golf ball paint delivery system which can be used for mixing paint adjacent to a nozzle of a spray gun from which the paint is delivered. In this regard, the present invention substantially fulfills this need.

SUMMARY OF THE INVENTION

In view of the foregoing disadvantages inherent in the known types of paint delivery systems now present in the prior art, the present invention provides an improved golf ball paint delivery system. As such, the general purpose of the present invention, which will be described subsequently in greater detail, is to provide a new and improved golf ball paint delivery system which has all the advantages of the prior art and none of the disadvantages.

To attain this, the present invention essentially comprises a plurality of closed paint containers adapted to contain paint therein at high pressures. Pumps are connected to each of the containers for extracting the paint therefrom and delivering the paint at a predetermined pressure. Further included is a plurality of spray guns connected to the pumps for spraying the paint received from the pumps synchronous with a driving of the pumps. In use, the spray guns each spray between 55 and 60 milligrams of paint to each golf ball within 440 milliseconds. As shown in FIG. 2, each spray gun has an axial bore formed therein with a first end connected to an air compressor for receiving a flow of air therefrom and a second open end defining a nozzle. The axial bore defines a central axis. Each spray gun further includes a first paint input channel connected to one of the pumps for receiving a first fluid therefrom. It should be noted that the first paint input channel has an axis defining an approximate 45 degree angle with the central axis. An outlet of the first paint input channel is in communication with the axial bore for injecting the first fluid into the flow of air. Associated with the first paint input channel is a second paint input channel connected to one of the pumps for receiving a second fluid therefrom. The second paint input channel has an axis defining an approximate 45 degree angle with the central axis and an outlet in communication with the axial bore for injecting the second fluid into the flow of air. It is imperative that the outlet of the second paint input channel is offset from the outlet of the first paint input channel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf ball paint delivery system with specifically sized connections for maximizing flow rates of the associated liquids and maintain a FIFO system.

It is another object of the present invention to provide a new and improved golf ball paint delivery system with decreased paths associated with gun tips and tees of the applicator guns thereof to decrease paint build up therein.

An even further object of the present invention is to provide a new and improved golf ball paint delivery system that bleeds off excess pressure build up after a predetermined amount of time by spraying the first empty spot to come along in front of the next ball indexing down an assembly line.

Still yet another object of the present invention is to provide a new and improved golf ball paint delivery system with pressure transducers for monitoring back pressure created by line and gun restrictions.

Still another object of the present invention is to provide a spray gun design wherein the components of the fluid emitted from the gun of the present invention enter a central stream offset from each other, thereby allowing the less aggressive component to flood the area next to the packing, preventing curing paint from entering the packing area and interfering with the gun needle.

Another object of the present invention is to mix paint adjacent to a nozzle of a spray gun from which the paint is delivered for the purpose of coating golf balls.

Lastly, it is an object of the present invention to provide a new and improved a spray gun for coating golf balls having an axial bore formed therein. The bore has a first end connected to an air compressor for receiving a flow of air therefrom and a second open end defining a nozzle. Each spray gun further includes a first paint input channel for receiving a first fluid. The first paint input channel has an outlet in communication with the axial bore for injecting the first fluid into the flow of air. Each spray gun also has a second paint input channel for receiving a second fluid, wherein the second paint input channel has an outlet in communication with the axial bore for injecting the second fluid into the flow of air. The outlet of the second paint input channel is offset from the outlet of the first paint input channel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a rear view of the spray gun of the present invention.

FIG. 5 is a top view of the spray gun of the present invention.

FIG. 6 is a side view of the spray gun of the present invention.

Similar reference characters refer to similar parts throughout the several views of the drawings.

DESCRIPTION OF THE PREFERRED EMBODIMENT

Figure 1:
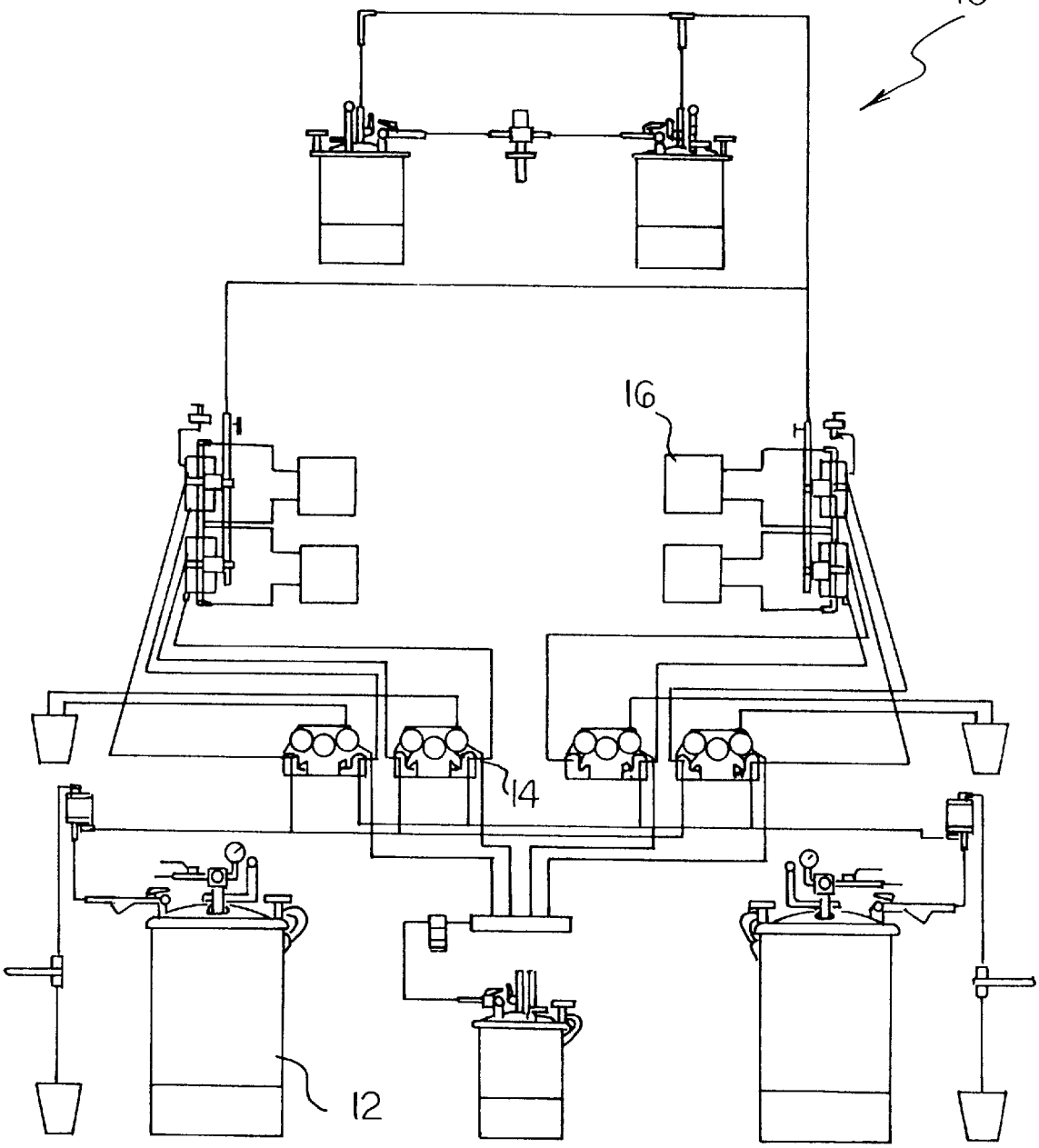
FIG. 1 is an illustration of the preferred embodiment of the golf ball paint delivery system constructed in accordance with the principles of the present invention.

With reference now to the drawings, and in particular to FIG. 1 thereof, a new and improved golf ball paint delivery system embodying the principles and concepts of the present invention and generally designated by the reference numeral 10 will be described.

The present invention, the new and improved golf ball paint delivery system, is comprised of a plurality of components. Such components in their broadest context include a plurality of paint containers, pumps, and spray guns. Such components are individually configured and correlated with respect to each other so as to attain the desired objective.

More specifically, it will be noted that the system 10 of the present invention includes a plurality of closed paint containers 12 adapted to hold paint therein at high pressures. Pumps 14 are connected to each of the containers for extracting the paint therefrom and delivering the paint at a predetermined pressure. In the preferred embodiment, such predetermined pressure is 10 psi.

Further included is a plurality of spray guns 16 connected to the pumps for spraying the paint received from the pumps synchronous with a driving of the pumps. In use, the spray guns each spray between 55 and 60 milligrams of paint to each golf ball within 440 milliseconds.

Figure 2:
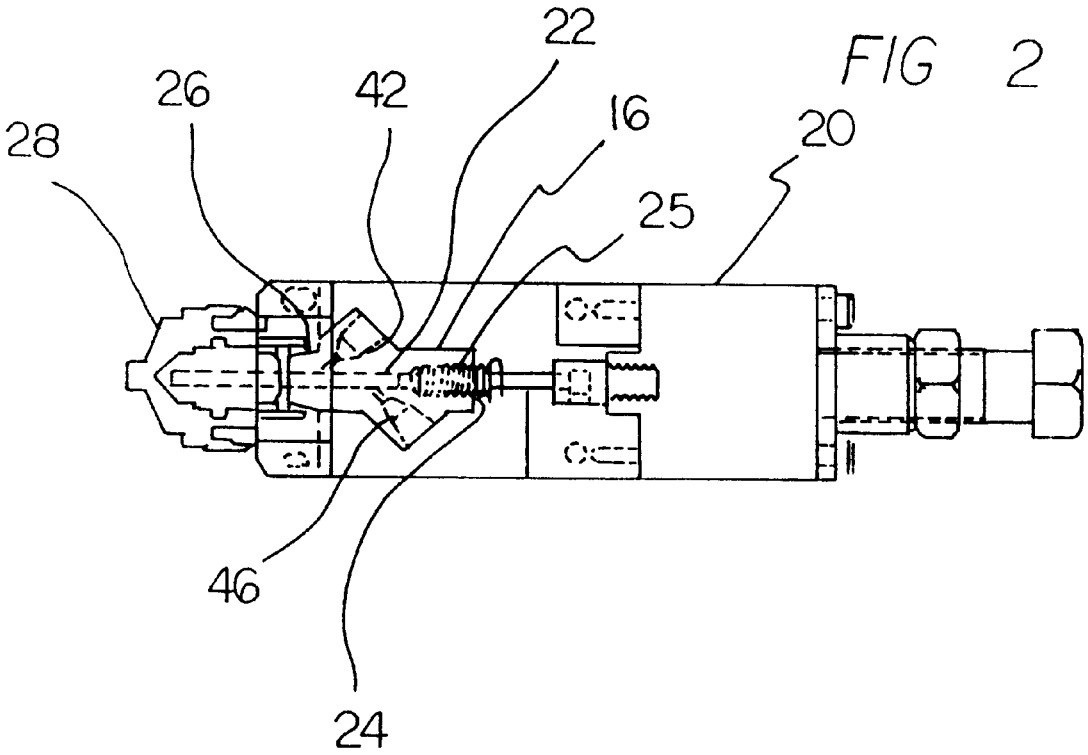
FIG. 2 is a side cross-sectional view of the spray gun of the present invention depicting the paint input channels thereof.

As shown in FIG. 2, each spray gun has is situated within a gun housing 20 having a cylindrical configuration. The spray gun includes an axial bore 22 formed therein with a first end 24 connected to an air compressor for receiving a flow of air therefrom. Such coupling is effected via coaxial threads 25 formed in an internal periphery of the first end of the axial bore. The spray gun further has a second open end 26 defining a nozzle that is connectable to a conventional nozzle cap assembly 28 of the gun housing. For facilitating connection with the nozzle cap, the spray gun has coaxial threads 30 formed in an external periphery thereof adjacent the second end of the axial bore. The axial bore defines a central axis. As specifically shown in FIG. 3, the axial bore has a rear extent 32 situated adjacent the first end thereof. In the preferred embodiment, the rear extent has a constant diameter of approximately 0.190 inches. The axial bore further includes a front extent 34 situated adjacent the second end thereof with a frusto-conical configuration. The inner periphery of the front extent of the axial bore defines an approximate 50 degree angle with the central axis of the axial bore. Located between the front and rear extent of the axial bore is an intermediate extent 36 having a constant diameter less than that of the rear extent. The interconnection between the rear and intermediate extent includes a reduced diameter portion 38 with a diameter less than that of the intermediate extent. The reduced diameter portion has tapered end portions 40.

Each spray gun further includes a first paint input channel 42 connected to one of the pumps for receiving a first fluid therefrom. It should be noted that the first paint input channel has an axis defining an approximate 45 degree angle with respect to the central axis. An outlet 44 of the first paint input channel is in communication with the axial bore for injecting the first fluid into the flow of air. Associated with the first paint input channel is a second paint input channel 46 connected to one of the pumps for receiving a second fluid therefrom. The second paint input channel has an axis defining an approximate 45 degree angle with the central axis and an outlet 48 in communication with the axial bore for injecting the second fluid into the flow of air. It is imperative that the outlet of the second paint input channel be offset from the outlet of the first paint input channel. Ideally, such offset is approximately 0.375 inches. Further, it should be noted that the outlets of the respective input channels are situated in diametrically opposed portions of the axial bore.

Figure 3:
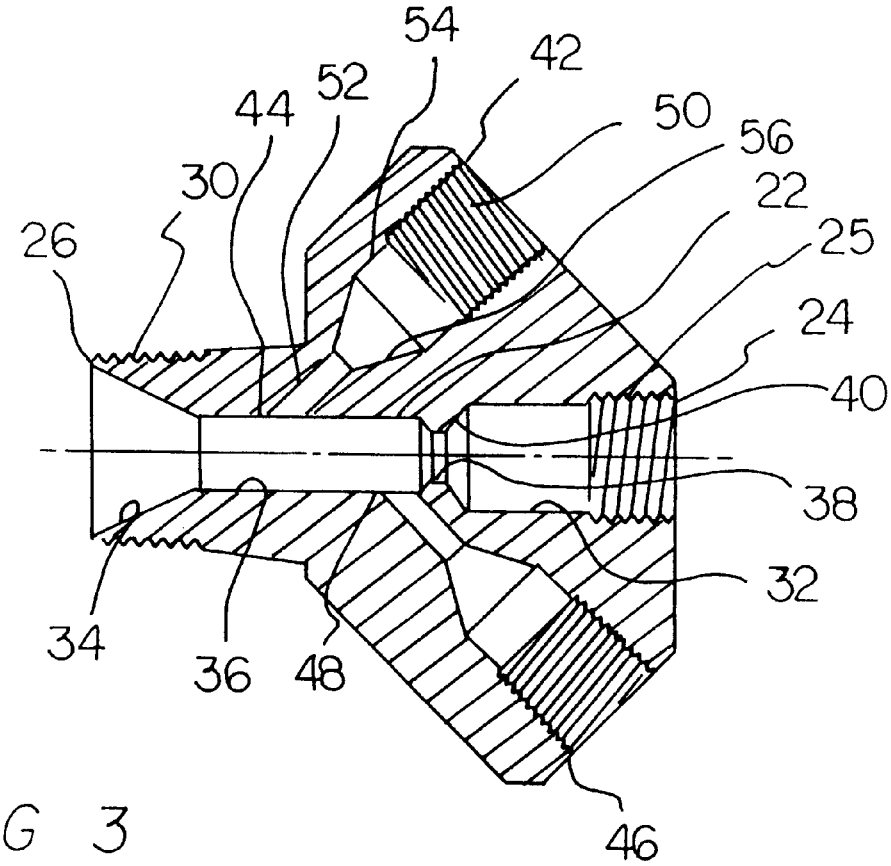
FIG. 3 is a cross-sectional view of the spray gun without the spray gun housing.

The coupling between the spray input channels and the respective pumps is accomplished by means of a plurality of coaxial threads 50 formed in the internal periphery of inlets of the input channels. Further, as shown in FIG. 3, each paint input channel has an output section 52 situated adjacent the outlet thereof with a cylindrical configuration of a constant diameter. Each paint input channel also has an input section 54 located adjacent the inlet thereof with a diameter greater than that of the output section. Positioned between the input and output section is a tapering section 56. It should between noted that in the preferred embodiment, the spray gun which contains the axial bore and the input channels is formed of a single integral unit.

By mixing the paints immediately prior to delivery adjacent the nozzle of the spray guns, a first in, first out (FIFO) system is afforded. Further, by offsetting the outlets of the paint input channels, the less aggressive component floods the area next to the packaging thus preventing curing paint from entering the packing area and interfering with the gun needle. In the preferred embodiment, the second end of the axial bore of the spray guns are each of a reduced size for reducing flow rates and decreasing paint build-up.

Situated throughout the system are pressure transducers for monitoring back pressure created by line and gun restrictions. Such pressure transducers also monitor low back pressure as an indicator of pump failure or an open paint line.

For periodically flushing the spray guns, a predetermined amount of the above mentioned containers are reserved for containing a cleaning solution. An air actuated 3-way valve is connected between the pumps, cleaning solution containers, and the spray guns. The valves are arranged so that after the solvent flushes the guns, all paint is valved off from the system. The valve is computer controlled for affording the proper operation of the system. Such computer performs additional functions such as controlling the pressure transducers for bleeding off excess pressure build up after 5 seconds or more by spraying the first empty spot to come along in front of the next ball indexing down an adjacent assembly line. Identification of the empty spot may be accomplished by optical sensors or the like. The computer may also be utilized in conjunction with the pressure transducers for stopping operation of the present invention if the pressures within the system become too high.

The present invention thus provides a system that employs a spray gun of a novel structure for clear coating golf balls. By the unique structure of the spray gun, the paint components of the clear coat mixture are brought together very close to the conventional atomizing nozzle assembly. By doing this, a minimum back pressure is afforded between the two components thus eliminating mixing of the paint components in the lines and eliminating the need for check valves or other equipment which can ultimately create maintenance problems. Further, the unique approach of the present invention shortens the path that the two paint components are in contact, yet promotes aggressive premixing and reduced back pressure and turbulence. In addition, the non-catalyzing fluid enters the gun at the needle packing. Such packing seals the needle from outside air which is beneficial since air carries moisture that ultimately hardens the fluid mixture. As such, a fluid buffer is afforded which isolates the packing from the catalyzing fluid. This is accomplished by ensuring that the catalyzing fluid enters downstream from the non-catalyzing fluid. It should be understood that by utilizing the non-catalyzing fluid as an isolator at the needle packing, maintenance on the gun and upstream components is reduced.

The method associated with the present invention is effected by first providing the forgoing system including the aforementioned spray gun. Further required components are as follows:

1. Fast dry two to one (2:1) POLY and ISO components.
2. Spalding #3 solvent (DOWAWOL)
3. D.I.N.P. special oil system
4. P.D.S paint system
5. Clear coat paint system
6. 35' of oven conveyor
7. Drying oven Proper machine set up consists of the following steps:

1. Check all pot levels: ISO, POLY, D.I.N.P., SOLVENT Fill as needed.
2. Turn power and air on to machine:
   5 psi to the paint pots.
   50 psi to the solvent pots.
   10 psi to the D.I.N.P. pot.
3. Turn on drying oven.
4. Check PDS system for air in paint lines on suction side of the pumps. Purge air through bleeder valves at either end of the cart.
5. Check for obstructions in and around the machine. Check safety gates.
6. Press RESET button an main console.
7. Start Blower, Spindle motor, Indexer and switch man./auto switch on main paint control cabinet to manual.
8. Press solvent button two times.
9. Press paint purge button three times and check paint lines for air. Purge air from ISO and POLY pots to guns by continuously pushing the paint button. Purge until no air is visible in lines.
10. Switch auto/setup switch to setup and check paint coverage and wet weights.
11. While the paint machine is in setup mode check digital gauges on the paint cart. Those gauges should not exceed 300 kpa (or 43.5 psi) at any time otherwise there is a restriction in the gun, mixer, 3-way valve or lines associated with the gauge. Check trouble shooting decision tree in the PDS operation and maintenance manual.

Production operation consists of the following steps:

1. a) Start blower, Spindle motor, and Indexer.
   b) Switch main console to manual and purge guns with paint 3 times.
   c) Put setup/auto switch at booth to setup and check wet weight.
2. Check oven to see if it is up to temperature. (normally 160 degF./170 degF.) Place the SETUP/AUTO switch into AUTO and the MAN/AUTO switch to auto.
3. Gauges on the output of the pumps should modulate between 45 kpa and 200 kpa. The window on the gauges should be set from 20 kpa (low) to 300 kpa (high). The green light on the front of the gauge will blink on and off with each pulse of the associated gun. The balls should be slightly tacky at output after the oven and dry to the touch 15 feet from the oven output.
4. Balls should be dye checked with each wet weigh.
5. THE MAXIMUM TIME THE PAINT SHOULD BE ALLOWED TO STAGNATE IN THE GUNS AND MIXER IS 12 MINUTES. After this the paint will begin to cure. Any paint that has cured will not dissolve with a solvent purge. The affected guns and tubing must be replaced.
   a) If the auto/man switch on the main console is in the auto position the red strobe will come on after eight minutes of not spraying. At ten minutes the indexer will stop and the guns will purge with solvent. Then the indexer will restart.
   b) When the next ball comes down the line the paint machine will stop and purge the guns with paint. Then the indexer will restart.
   c) If any spray gun does not spray for five indexes that gun will spray the empty space before the next ball.
6. IF THE AUTO/MAN SWITCH ON THE MAIN CONTROL CABINET IS IN MANUAL THEN THE OPERATOR IS RESPONSIBLE FOR THE PAINT IN THE GUNS.
7. PDS is shut down by emptying the balls from the track and by switching the auto/setup switch to setup. Wait until all the balls have cleared the picker. Press the solvent purge button located on paint booth console two times. Watch to see that solvent properly purges all four guns. Stop the indexer, spin motor, and blower.

The process associated with the clear coat automatic metering spray system consists of the following steps:

1. ISO and POLY are pressurized to 5 psi in their respective pots.

2. The ISO and POLY flow through 125 micron (200 mesh) filters. The air in the system migrates to a top sight glass and the air is bled off.
3. The ISO and POLY flow to their respective pumps.
4. The 0.584 cc/rev (POLY) and 0.297 cc/rev (ISO) are controlled by the Galil DMC 1040 motion control card mounted in a IBM compatible PC. The Galil card sends the motor profile to the Pacsi 5340 amplifier in the form of a pulse train.
5. Both POLY and ISO pumps are rotated from one main gear attached to the stepper motor shaft. The ratio pumped is the ratio of the two volume's of the pumps 0.584/0.297=2/1.
6. The paint is pumped in a pulse mode to air actuated valves that keeps the two fluids separated. The valves also serve to permit flushing each paint component when the conveyor is not delivering balls.
7. The ISO and POLY are combined in the gun.
8. The ISO and POLY are delivered to the gun via a specially designed Dual FluidTee. The Tee minimizes clogging and leakage.
9. The combined paint is accelerated through the gun internal passage ways to provide increased velocity, mixing and reduced paint buildup internal to the gun.
10. Stock pinks fluid and air nozzles are used to provide the proper paint spray pattern.
11. The balls are presented to the guns and the gun trigger signal is derived from a resolver located on the main indexing shaft.
12. The paint is thoroughly mixed in the atomizing air stream of the paint gun.
13. The guns and pumps are triggered and profiled at the same time, although there is a time delay before the pump pressure pulse exits through the gun. The balls are sprayed for two revolutions.
14. When there is no ball in front of a gun, that gun does not trigger and the associated pumps do not operate.
15. When the system does not see any balls for five indexes, the indexer stops and the guns are solvent flushed. When balls became available, the indexer restarts, then when the first ball is detected, the guns relieve the line pressure by spraying the empty positions ahead of the oncoming balls. This over pressure condition builds up as the system pressures equalize when the system is stagnant for more than 10 seconds, to a point where the next spray is heavy and out of specification. (Specification calls for 110–120 mg
16. In summation: When the system does not see a ball for 8 min:
    A. The indexer is stopped.
    B. Solvent to the ISO and POLY 3 way valves are rotated to solvent flush.
    C. Guns are triggered and solvent is flushed through the mixer and the guns.
    D. The indexer is restarted.
    E. On seeing a ball the indexer stops two spaces before the first ball and purgers the mixers and guns with paint and restarts the indexer.

All ISO pumps incorporate a double lip seal. This lip seal is located where the pump shaft exits the housing. This double lip seal is flooded with a special oil ( D.I.N.P.). The oil keeps air and moisture from entering the shaft area, which would otherwise cause the ISO to solidify with subsequent pump failure. Thirty CC's of D.I.N.P. is introduced, every hour, into the bottom of the double lip seal and vented through the top to evacuate any air or ISO contaminates.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf ball paint delivery system comprising, in combination:

a plurality of closed paint containers adapted to contain paint therein at high pressures;

a plurality of pumps connected to each of the containers for extracting the paint therefrom and delivering the paint at a predetermined pressure;

a plurality of spray guns connected to the pumps for spraying the paint received from the pumps synchronous with a driving of the pumps, whereby the spray guns each spray between 55 and 60 milligrams of paint to each of a plurality of golf balls within 440 milliseconds;

said spray guns each having a generally cylindrical configuration with an axial bore formed therein with a first end connected to an air compressor for receiving a flow of air therefrom and a second open end defining a nozzle, wherein the axial bore defines a central axis, each spray gun further including a first paint inputchannel connected to one of the pumps for receiving a first fluid therefrom, the first paint input channel having an axis defining an approximate 45 degree angle with the central axis and an outlet in communication with the axial bore for injecting the first fluid into the flow of air, each spray gun further including a second paint input channel connected to one of the pumps for receiving a second fluid therefrom, the second paint input channel having an axis defining an approximate 45 degree angle with the central axis and an outlet in communication with the axial bore for injecting the second fluid into the flow of air, the outlet of the second paint input channel being offset from the outlet of the first paint input channel whereby the outlet of the first paint channel is positioned at a first distance from the second open end of the axial bore and the outlet of the second paint channel is positioned at a second distance from the second open end of the axial bore, the second distance being greater than the first distance when measured along a length of the axial bore.

* * * * *